US005505456A

United States Patent [19]

Schmidt

[11] Patent Number: 5,505,456

[45] Date of Patent: Apr. 9, 1996

[54] BOARD GAME FOR EVALUATING SKILL IN SCRAMBLING AND UNSCRAMBLING OF WORDS

[76] Inventor: John Schmidt, 9 Andree Pl., Mercerville, N.J. 08619

[21] Appl. No.: 227,767

[22] Filed: Apr. 14, 1994

[51] Int. Cl.[6] ..... A63F 3/00

[52] U.S. Cl. ..... 273/272; 273/431; 273/432; 434/167

[58] Field of Search ..... 273/272, 429, 273/430, 431, 432; 434/159, 167, 322

[56] References Cited

U.S. PATENT DOCUMENTS

| | | | |
|---|---|---|---|
| 1,201,100 | 10/1916 | Rice-Wray . | |
| 3,393,914 | 7/1968 | Hill . | |
| 3,746,342 | 7/1973 | Fine . | |
| 3,982,764 | 9/1976 | Dieball . | |
| 4,350,342 | 9/1982 | Barulich . | |
| 4,468,035 | 8/1984 | Slepian . | |
| 4,509,758 | 4/1985 | Cole . | |
| 4,900,031 | 2/1990 | Wohl . | |
| 4,907,807 | 3/1990 | Lee et al. . | |
| 4,923,199 | 5/1990 | Hahn . | |
| 4,955,614 | 9/1990 | Buda | 273/272 |
| 5,067,720 | 11/1991 | Bundy . | |
| 5,149,103 | 9/1992 | Ross . | |
| 5,195,753 | 3/1993 | Brukl et al. | 273/429 |
| 5,207,435 | 5/1993 | Tanner | 273/272 |

FOREIGN PATENT DOCUMENTS

| | | | |
|---|---|---|---|
| 2189159 | 10/1987 | United Kingdom | 273/254 |

*Primary Examiner*—Vincent Millin
*Assistant Examiner*—William M. Pierce
*Attorney, Agent, or Firm*—Sperry, Zoda & Kane

[57] ABSTRACT

A competitive board game including the purposeful scrambling and unscrambling of numerous words, mostly nouns, chosen from a variety of categories randomly by a plurality of teams each having one or more players which includes individual team playing tokens movable upon a sequential path of spaces defined upon the upper planar surface of the game board. Included is a pass category for allowing an active team to force an inactive team to perform the unscrambling within a sixty second time period. There is also a choice option allowing the active team to choose any one of the available categories.

17 Claims, 3 Drawing Sheets

BOARD GAME FOR EVALUATING SKILL IN SCRAMBLING AND UNSCRAMBLING OF WORDS

BACKGROUND OF THE INVENTION

1. Field of the Invention

The present invention deals with the field of games for use in evaluating word skills among the participating players. Many such games have been designed for improving the vocabulary and word power characteristics of players while competing in an enjoyable, competitive gaming environment utilizing multiple players and multiple teams. The game of the present invention provide a novel improvement and a step forward in the state of art of games of this nature.

2. Description of the Prior Art

Prior art devices have been patented on board game and other word oriented games such as U.S. Pat. No. 1,201,100 patented Oct. 10, 1916 to M. S. Rice-Wray on a "Game Apparatus"; and U.S. Pat. No. 3,393,914 patented Jul. 23, 1968 to I. M. Hill on a "Letter And Name Game Apparatus"; and U.S. Pat. No. 3,746,342 patented Jul. 17, 1973 to M. Fine and assigned to Nuword Game, Inc. on a "Word Forming Game Apparatus"; and U.S. Pat. No. 3,982,764 patented Sep. 28, 1976 to W. Dieball on an "Electrical Game Apparatus"; and U.S. Pat. No. 4,350,342 patented Sep. 21, 1982 to T. Barulich on a "Word Game Apparatus"; and U.S. Pat. No. 4,468,035 patented Aug. 28, 1984 to J. Slepian on a "Word Forming Game Apparatus"; and U.S. Pat. No. 4,509,758 patented Apr. 9, 1985 to J. Cole on a "Cryptographic Game Apparatus And Mode Of Play"; and U.S. Pat. No. 4,900,031 patented Feb. 13, 1990 to K. Wohl on a "Board Game"; and U.S. Pat. No. 4,907,807 patented Mar. 13, 1990 to D. Lee et al on a "Board Game For Playing Crossword Puzzles"; and U.S. Pat. No. 4,923,199 patented May 8, 1990 to E. Hahn on a "Word Making Card Game"; and U.S. Pat. No. 5,067,720 patented Nov. 26, 1991 to W. Bundy on a "Board Game Apparatus"; and U.S. Pat. No. 5,149,103 patented Sep. 22, 1992 to A. Ross on a "Word Extracting Word Game And Method"; and U.S. Pat. No. 5,207,435 patented May 4, 1993 to S. Tanner on a "Word Game".

SUMMARY OF THE INVENTION

The present invention provides a board game which includes at least two teams which develop skills in scrambling and unscrambling of words, usually nouns. The present invention includes a game board having a plurality of sequential playing spaces on the upper planar surface thereof including a starting space and a finishing space. The players participating in the game are divided into at least two teams of one player each. A playing sequence is established for all participating teams in order to sequentially allow each team to become the active team. The playing sequence can be established by using a standard random number generator such as a six-sided die.

A playing token is chosen for each participating team. These playing tokens are preferably distinguishable from one another to identify the playing team associated with the specific token.

In the actual game play, the initially active team chooses a question category in a random manner. This manner may include the rotating of a spinner by a player of the active team through a plurality of zones corresponding to the question categories in such a manner as to randomly choose the category for the active player for this turn. In order for the rotation of the spinner to accurate, the spinner must at least pass over all zones at least once prior to stopping.

A game card is then secretly picked by a player of the scrambling team which normally is the next team in the player sequence. This game card will include categories thereon corresponding to the categories from which the spinner makes random choice.

Once the category has been determined by spinning, the scrambling team can view the game card and invert it to find the particular word corresponding to the chosen category. This particular word may also include a numeral indicating difficulty level thereadjacent.

It is then the job of the scrambling to scramble the alphanumeric characters of this word and normally to write it on a piece of paper ready to be viewed by the active team. The scrambling team normally has thirty seconds to perform this scrambling activity. Once the scrambled word has been shown to the active team they have sixty seconds within which to correctly identify the word unscrambled.

If they do correctly identify the word, their token is moved forward along the game play path a number of spaces equal to the difficulty numeral positioned on the game card adjacent to the current word. If they are unable to identify the word from the scrambled version then the game playing token of the scrambling team is moved forward a number of spaces equal to the numeral adjacent to the current word on the game play card.

Thereafter the next team in the team sequence becomes the active team and play proceeds in a similar manner until one team has moved its token at least as far as the finish space through the game play zones. Then that team is declared the winner and the game has been concluded.

It is an object of the present invention to provide a board game for evaluating skill in scrambling and unscrambling of words wherein unscrambling of words is practiced to a great extent.

It is an object of the present invention to provide a board game for evaluating skill in scrambling and unscrambling of words wherein scrambling of the alphanumeric characters of a word is equally important to unscrambling thereof.

It is an object of the present invention to provide a board game for evaluating skill in scrambling and unscrambling of words wherein development of word power skills by game players is achieved.

It is an object of the present invention to provide a board game for evaluating skill in scrambling and unscrambling of words wherein educational English skills are developed in a competitive friendly environment.

It is an object of the present invention to provide a board game for evaluating skill in scrambling and unscrambling of words wherein initial capital outlay for equipment is minimized.

It is an object of the present invention to provide a board game for evaluating skill in scrambling and unscrambling of words wherein maintenance costs are extremely minimal.

It is an object of the present invention to provide a board game for evaluating skill in scrambling and unscrambling of words wherein friendly competition is encouraged between multiple players on multiple teams.

It is an object of the present invention to provide a board game for evaluating skill in scrambling and unscrambling of words wherein a fast enjoyable game can be enjoyed within a learning environment.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
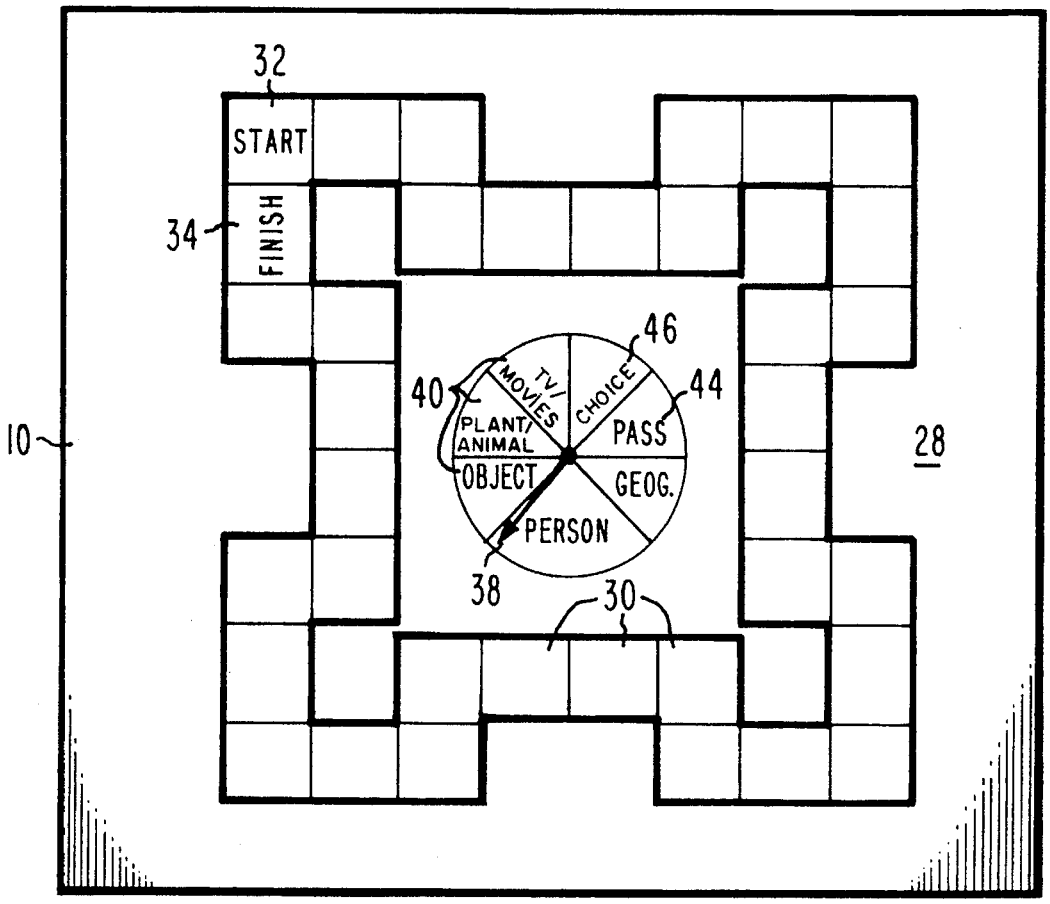
FIG. 1 is a top plan view of an embodiment of the game board of the present invention.
Figure 2:
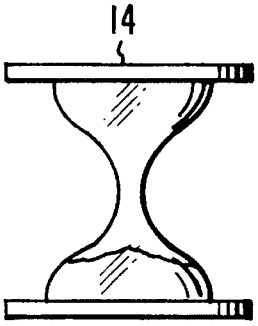
FIG. 2 is a front plan view of an embodiment of a timing device of the present invention.
Figure 3:
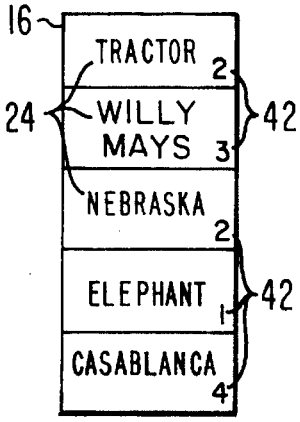
FIG. 3 is a rear plan view of an embodiment of the game card of the present invention.
Figure 4:
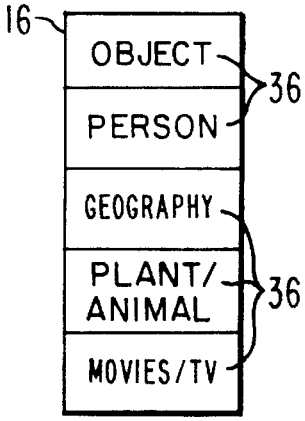
FIG. 4 is a front plan view of an embodiment of the game card of the present invention.
Figure 5:
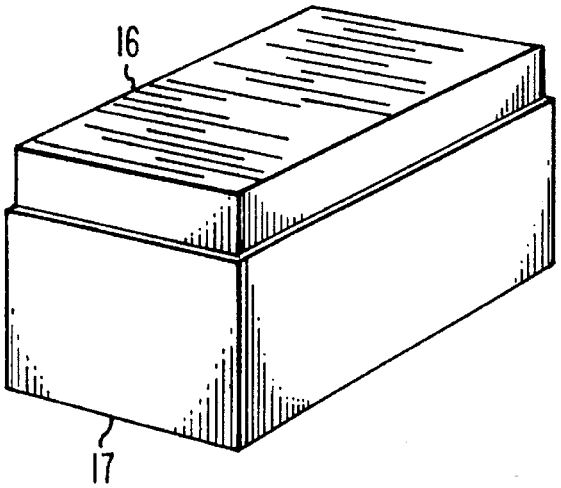
FIG. 5 is a perspective view of a plurality of game cards shown retained within a retaining box therefore.
Figure 6:
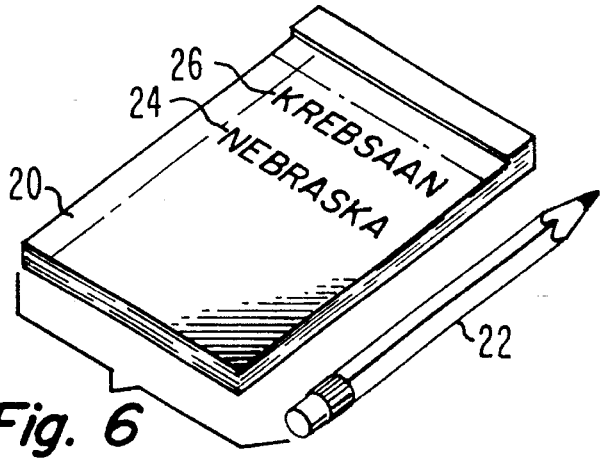
FIG. 6 is a writing instrument shown in use with a pad in accordance with the method of the game of the present invention.
Figure 7:
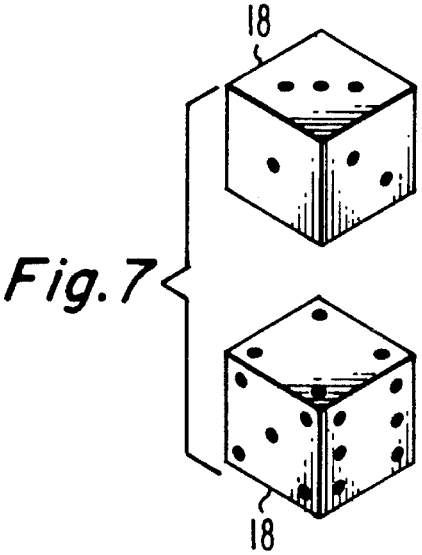
FIG. 7 is a front and rear three-quarter perspective view of a random number generator such as a six-sided die of the present invention.
Figure 8:
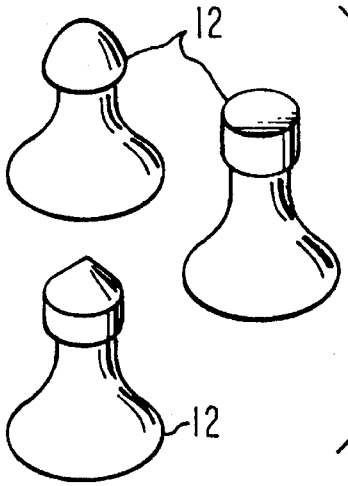
FIG. 8 is a view of example of game pieces which may be used with the present invention.
Figure 9:
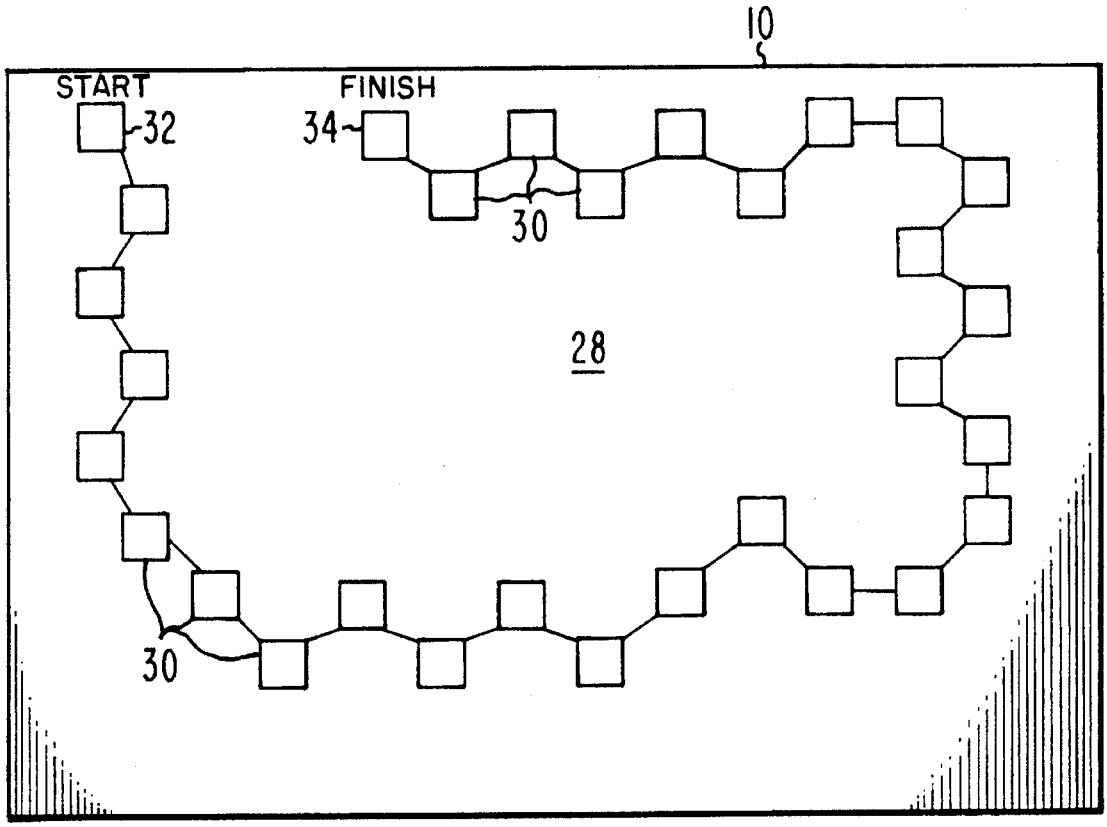
FIG. 9 is a top plan view of an alternative configuration of the game board of the present invention.

The present invention comprises a board game 10 which includes the scrambling and unscrambling of various words, normally nouns, in a competitive environment such as to determine a game winner. The board game includes a game board 10 with a plurality of team playing tokens 12 usable for identifying the several teams participating in the game. Each team can include numerous members and the number of teams is not limited although play with more than four teams is normally not recommended.

The board game 10 includes a plurality of game cards 16 each of which has a plurality of words 24 thereon adapted to be scrambled by certain teams during game play. A die 18 is included for randomly determining the sequence of play among the different teams. A timer 14 is included for defining a specific time period within which words 24 must be unscrambled from the scrambled form such as at 26.

The upper game board surface 28 includes a plurality of playing spaces 30 thereon which are sequentially defined from the starting space 32 to the finishing space 34.

Game play involves initially with randomly defining a question category 36 by, for example, the rotation of a spinner 38 in a position immediately above the plurality of spinning zones 40. Each of the different zones corresponds to a different category 36 of words 24. Each word 24 can be associated with a difficulty numeral 42 wherein the higher the numeral the more difficult the word is to be scrambled as well as unscrambled.

The apparatus of the game includes paper 20 and writing instrument 22 to facilitate scrambling and unscrambling of the words 24.

The spinning zones 40 of the spinner 38 preferably can include a game category entitled Choice 46 which allows the active player to choose any category desired. Also the playing zones 40 may include a game category PASS 44 which allows the active player to switch places with the scrambling player for the purposes of scrambling and unscrambling the particular word used in that certain turn.

The apparatus of the game preferably includes a game board 10 itself which defines the path of movement through the plurality of playing spaces 30 defined thereon. The game board 10 may also include the random category choosing device such as the spinner 38 rotatably mounted thereon with the spinning zones 40 defined thereunder as shown in FIG. 1. These plurality of sequential playing spaces are in position on the upper planar surface of the game board 10 in such a manner as to provide the competitive aspect of the present invention.

The players will then be divided into two or more teams with at least one player on each team. The board game 10 of the present invention is particularly advantageous with multiple teams having multiple persons within each team. This adds to the speed of play, the enjoyment of play and the mutual interaction between players.

A player sequence can then be determined preferably by the rolling of the die 18 such that sequence of teams to become the active team is established. Normally the highest number goes first and the lower numbers go consecutively thereafter. This sequence is important to show that only one team is active at a given time. The active team is the team which is being called upon to perform the unscrambling of the category words.

Each team chooses a particular playing token each of which is preferably distinguishable from one another such that the position of the team in progress between the starting space 32 and the finishing space 34 is readily evident upon viewing the game board 10. Initially all of the playing tokens are positioned on the starting space 32 to initiate game play.

At the beginning of the turn of a given player who is termed the active player, they are initially responsible to choose a category preferably by rotating of the spinner on the game board such that the spinner comes to rest in a category which becomes the chosen category. In order to be a valid spin the spinner 38 must pass through all spinner zones 40 defined therebelow prior to stopping. An invalid spin results in a re-spin. Once the category is chosen the team responsible for the scrambling which is referred to as the scrambling team will choose the next card in sequence of the game cards 16. Normally the scrambling team is the next team in the sequence of play.

It is the job of the scrambling team to identify the word on the chosen game card 16 corresponding to the category chosen by the active team when rotating the spinner 38. The scrambling team now has approximately thirty seconds to scramble the alphanumeric characters of that word as desired. It is the mission of the scrambling team to make the order of alphanumeric characters after scrambling to be as difficult as possible to unscramble by the active team. At all times the scrambling team keeps the chosen card hidden such as to prevent revealing of the current active word in the unscrambled format.

Once the word has been scrambled to an extent satisfactory to the scrambling team by writing the letters sequentially upon the paper 20, the timing device is started and the scrambled word is shown to the active team. The timing device would preferably be a sixty second timer such as a hourglass sand timer or the like. It is the mission of the active team to correctly unscramble the word or noun 24 to identify the word on the game card corresponding to the chosen category.

In normal game play, if the active team correctly identifies the word prior to the expiration of the time limit, their game playing token will be advanced one or more playing spaces toward the finish. On the other hand, if they are unsuccessful in identifying the scrambled word prior to the expiration of the time period, the game playing piece of the scrambling team will be advanced one or more playing spaces toward the finish.

In an embodiment of the game of the present invention a numeral will be included adjacent to the current game word which will indicate the difficulty level of that word. This numeral will be used to provide added importance to the scrambling and unscrambling of the current word. This added importance is used by allowing the active player, if successful in identifying the scrambled word, to move their team playing piece forwardly toward the finish space a number of spaces equal to the numeral. On the other hand, if they are unable to identify the word having a specific difficulty numeral greater than one, then the team playing piece of the scrambling team will be moved forwardly a number equal to the numeral on the game card 16 adjacent to the current word 24. In this manner a distinct difference can be placed on game play by the application of more importance upon words that are more difficult to scramble and unscramble.

Once the proper team playing token 12 has been moved forwardly, the scrambling team becomes the active team and the next team in the team sequence becomes the scrambling team. If there are only two teams, then each team alternates between being the scrambling team and being the active team on each alternate turn sequence.

The words used for scrambling will normally be nouns. These nouns may be proper nouns or common nouns. For the purposes of identification all proper nouns will preferably be shown in all capital letters. In this manner the team attempting to perform the unscrambling will already be aware that it is a proper noun since the scrambled word itself will be shown in upper case characters.

In some embodiments of the game of the present invention the word categories 36 may include the category "CHOICE". The "CHOICE" will allow the active team to choose any of the standard categories that would have been possible by random choice of rotation of the spinner.

Also the game categories 36 may include the term result "PASS". If the rotation of spinner 36 results in the choice of the term "PASS", then the active player has the option of becoming the scrambling team for the purposes of the current question only. If this option were chosen, then the scrambling team would become responsible for unscrambling the word and the active team would be responsible for scrambling of the word. The results would be identical to a normal turn except that the duty for scrambling would be on the active team and the duty of unscrambling would be on the otherwise scrambling team. There would be no effect on the next game turn sequence.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A method of playing a board game for at least two teams, which tests skills in scrambling and unscrambling of words, comprising:

A. providing of a game board defining a plurality of sequential playing spaces thereon including a starting space and a finishing space;

B. dividing of the players into at least two teams of at least one player each;

C. establishing a playing sequence for all participating teams;

D. designating the first team in the playing sequence as the active team and the next team in the playing sequence as the scrambling team;

E. positioning of a playing token for each participating team in the starting space on the game board;

F. choosing of a question category by the active team in a random manner;

G. picking of a game card, having a plurality of words thereon formed of a plurality of alphanumeric characters and each corresponding to a category, secretly by a player of a scrambling team which is a team other than the active team;

H. identifying of the word on the game card corresponding to the question category randomly chosen by the active team, said identifying performed secretly by the scrambling team;

I. arranging of the alphanumeric characters of the identified word secretly in scrambled order by the scrambling team;

J. starting of a timing device to remain activated for a predesignated time period;

K. disclosing of the identified word in scrambled order by the scrambling team to the active team;

L. attempting to correctly identify the correct spelling of the scrambled word by the active team prior to termination of the predesignated time period by the timing device;

M. moving of the playing token of the active team forwardly at least one space toward the finishing space on the game board responsive to correctly identifying and unscrambling of the scrambled word by the active team prior to signaling of the timing device;

N. moving of the playing token of the scrambling team forwardly at least one space on the game board toward the finishing space responsive to a failure of the active team to correctly identify and unscramble the scrambled word prior to signaling of the timing device; and O. initiating another game turn by making the next team in the playing sequence become the active team and restarting the game turn sequence by returning to the above step of choosing of a question category by the active team in a random manner.

2. A method of playing a board game for at least two teams, which tests skills in scrambling and unscrambling of words, as defined in claim 1 wherein steps F through O are repeated until one of the player tokens reaches the finishing space and that team is declared the game winner.

3. A method of playing a board game for at least two teams, which tests skills in scrambling and unscrambling of words, as defined in claim 1 wherein said choosing of question category includes rotating of a spinner through a plurality of zones designated on the game board therebelow corresponding to the question categories for randomly choosing of one by the active team.

4. A method of playing a board game for at least two teams, which tests skills in scrambling and unscrambling of words, as defined in claim 3 wherein rotating of the spinner is performed by the active team.

5. A method of playing a board game for at least two teams, which tests skills in scrambling and unscrambling of words, as defined in claim 3 wherein the spinner must rotate over all zones at least once in order for a spin to be usable to choose a question category with the remedy for failure being another spin by the active team.

6. A method of playing a board game for at least two teams, which tests skills in scrambling and unscrambling of words, as defined in claim 1 wherein the timing device provides a sand timer.

7. A method of playing a board game for at least two teams, which tests skills in scrambling and unscrambling of words, as defined in claim 1 wherein the game board provides an upper planer surface thereon and the plurality of sequential playing spaces on the game board are defined on the upper planer surface thereof.

8. A method of playing a board game for at least two teams, which tests skills in scrambling and unscrambling of words, as defined in claim 1 wherein the playing tokens are distinguishable from one another to provide accurate identification of the teams.

9. A method of playing a board game for at least two teams, which tests skills in scrambling and unscrambling of words, as defined in claim 1 wherein said arranging of the alphanumeric characters of the identified word secretly in scrambled order by the scrambling team is provided by writing of the scrambled word onto a sheet of paper by the scrambling team.

10. A method of playing a board game for at least two teams, which tests skills in scrambling and unscrambling of words, as defined in claim 1 wherein said establishing of a playing sequence for all participating teams is performed using a random number generating device.

11. A method of playing a board game for at least two teams, which tests skills in scrambling and unscrambling of words, as defined in claim 1 wherein said arranging of the alphanumeric characters of the identified word is performed secretly by the scrambling team is a timed period of less than 30 seconds.

12. A method of playing a board game for at least two teams, which tests skills in scrambling and unscrambling of words, as defined in claim 1 wherein the sequential playing pieces on said game board are provided positioned adjacent to one another.

13. A method of playing a board game for at least two teams, which tests skills in scrambling and unscrambling of words, as defined in claim 1 wherein said choosing of a question category by the active team provides a category entitled "CHOICE", wherein selecting of this category provides the active team the option of choosing any of the categories displayed on the card.

14. A method of playing a board game for at least two teams, which tests skills in scrambling and unscrambling of words, as defined in claim 1 wherein said choosing of a question category by the active team includes a special category entitled "PASS", selecting of this special category allowing the active team the option of becoming the scrambling team for the purposes of this current turn only with the scrambling team becoming the active team for the purposes of this current turn only.

15. A method of playing a board game for at least two teams, which tests skills in scrambling and unscrambling of words, as defined in claim 1 wherein each of the words on the game card includes a numeral providing the difficulty level of the word and the number of spaces along the sequential playing spaces for moving the playing token of the active team forwardly responsive to the active team correctly identifying of the scrambled word, and wherein the numeral also provides the number of spaces along the sequential playing spaces for moving the playing token of the scrambling team forwardly responsive to a failure of the active team to correctly identify the scrambled word.

16. A method of playing a board game for at least two teams, which tests skills in scrambling and unscrambling of words, as defined in claim 1 wherein all words in the categories on the games cards are provided as nouns.

17. A method of playing a board game for at least two teams, which tests skills in scrambling and unscrambling of words, comprising:

A. providing of a game board defining a plurality of sequential playing spaces on the upper planar surface thereof including a starting space and a finishing space;

B. dividing of the players into at least two teams of at least one player each;

C. establishing a playing sequence for all participating teams, said establishing of a playing sequence being performed using a random number generating device comprising a six-sided die;

D. designating the first team in the playing sequence as the active team and the next team in the playing sequence as the scrambling team;

E. positioning of a playing token for each participating team in the starting space on the game board, the playing token of each team being distinguishable from the playing tokens of all other teams;

F. choosing of a question category by the active team in a random manner, said choosing of question category including rotating of a spinner by the active team through a plurality of zones corresponding to the question categories for randomly choosing of one by the active team wherein the spinner must pass over all zones at least once in order for a spin to be acceptable;

G. picking of a game card, having a plurality of words thereon each corresponding to a category and each formed of a plurality of alphanumeric characters, secretly by a player of a scrambling team which is the next team in the playing sequence after the active team;

H. identifying of the word on the game card corresponding to the question category randomly chosen by the active team, said identifying performed secretly by the scrambling team, all words identified on the game cards being nouns, each words including a numeral thereadjacent indicating the difficulty level of that word;

I. arranging of the alphanumeric characters of the identified word secretly by writing them on a sheet of paper in scrambled order within a time period of approximately 30 seconds by the scrambling team;

J. starting of a timing device adapted to remain activated for a 60 second time period after starting thereof, said timing device comprising a sand timer hour glass;

K. disclosing of the identified word in scrambled order by the scrambling team to the active team;

L. attempting to correctly identify the correct spelling of the scrambled word by the active team prior to termination of the 60 second time period by the timing device;

M. moving of the playing token of the active team forwardly a number of spaces equal to the difficulty level numeral of the current word toward the finishing space on the game board responsive to correctly identifying and unscrambling of the scrambled word by the active team prior to termination of the 60 second time period;

N. moving of the playing token of the scrambling team forwardly a number of spaces equal to the difficulty level numeral of the current word toward the finishing space responsive to a failure of the active team to correctly identify and unscramble the scrambled word prior to termination of the 60 second time period of the timing device; and O. initiating another game turn by making the next team in the playing sequence become the active team and restarting the game turn sequence by returning to the above step of choosing of a question category by the active team in a random manner, initiating of another game turn being repeatedly performed until one of the playing tokens reaches the finishing space with the corresponding team being declared the winner.

* * * * *